US005198126A

United States Patent [19]

Lee

[11] Patent Number: 5,198,126

[45] Date of Patent: Mar. 30, 1993

[54] TUBULAR REFRACTORY PRODUCT

[75] Inventor: Stephen J. Lee, Cardross, Scotland

[73] Assignee: Thor Ceramics Limited, Clydebank, England

[21] Appl. No.: 667,985

[22] Filed: Mar. 12, 1991

Related U.S. Application Data

[63] Continuation-in-part of Ser. No. 399,453, Oct. 27, 1989, abandoned.

[30] Foreign Application Priority Data

Feb. 28, 1987 [GB] United Kingdom ..... 8704764

[51] Int. Cl.[5] ..... B22D 41/08

[52] U.S. Cl. ..... 222/606; 222/600

[58] Field of Search ..... 222/591, 600, 606, 607; 266/236

[56] References Cited

FOREIGN PATENT DOCUMENTS 0158562 7/1987 Japan ..... 222/606

1157818 7/1969 United Kingdom ..... 222/606

*Primary Examiner*—Scott Kastler

*Attorney, Agent, or Firm*—Sixbey, Friedman, Leedom & Ferguson

[57] ABSTRACT

A refractory pouring-assembly component for use with a tube changer mechanism comprises an elongate tubular body having a throughbore for pouring of molten metal during continuous casting from a tundish into a mould wherein the refractory pouring component is an isostatically pressed, heat- and wear-resisting refractory one-piece composite body which is shaped to provide at one end a smooth, flat plate surface in which there is defined an aperture, the peripheral edge around said aperture being formed of a hard refractory material to provide a cutting edge around the throughbore, whilst the remainder of said body is formed to a tubular shape from a thermal shock-resistant material to provide for pouring of melt. The compositions of said component may be uniform blends of refractory material bonded by silicon nitride or silicon oxy-nitride or an annulus of selected hard materials within a graphite/alumina host body.

11 Claims, 4 Drawing Sheets

TUBULAR REFRACTORY PRODUCT

PRIOR RELATED APPLICATIONS

The present application is a continuation-in-part of my earlier application Ser. No. 399,453, filed Oct. 27, 1989.

BACKGROUND OF THE INVENTION

This invention relates to a refractory product for use in continuous casting. More particularly the invention is concerned with tubular refractory products for use in pouring of melt from the tundish to the mould. Flow of melt from the tundish into a mould is commonly controlled by raising or lowering of a refractory stopper rod from or to a seating position in the base of the tundish where there is located either a fixed sub-entry nozzle (SEN) or a tundish nozzle, built into the tundish base, onto which a sub entry shroud (SES) is fastened. In place of stopper rod valve closures, a slide gate control mechanism to which the SEN or SES is attached is also known.

Recently some steelmakers have been fitting to the underside of the tundish a fairly simple mechanism which enables quick changeover of such pouring tubes to minimise loss of time and production in replacing worn or damaged tubes. Such a tube-changer is described in GB-A-1 597 215 whilst another is disclosed in EP-A-0 192 019. When an SES is cracked or worn out the mechanism rapidly pushes out the used piece and drives a new tube into alignment underneath the metal stream, for example by means of a piston arrangement.

The present systems use an upper nozzle having a seating position to receive a flow control stopper located within a well block fixed into the tundish lining against which a stationary plate is fitted and incorporating a suitable jointing arrangement between the two components. A lower assembly is held in place against the underside of this stationary plate by the tube changer mechanism and comprises a moving plate and submerged pouring shroud jointed by a suitable arrangement and retained within a strengthening steel shell which serves to hold the two components firmly together and to withstand the pressures transmitted by the operating piston.

Whilst improvements have been made in the tube changing mechanisms since their introduction, there remain problems in ensuring adequate fitting of the respective mating surfaces of the tube, nozzle and upper or stationary plate and the lower or sliding plate of the tube changer and the submerged pouring shroud. If improper fitting of these refractory components occurs then air/oxygen leakage through the misfitting joints is possible with detrimental effect upon the quality of the steel. Air/oxygen penetrating the joints reacts with the alumina in the steel leading to build up of alumina deposits and clogging of the pouring tube. Such reaction also yields a problem manifesting itself as inclusions in the casting commonly identified as black spot.

Thus those in this field have hitherto sought to mitigate such problems by seeking to improve the tube handling and change-over systems leading to ever more complex and expensive handling systems.

SUMMARY OF THE INVENTION

An object of the present invention is to obviate or mitigate the aforementioned problems by providing improved pouring tubes suitable for use in conjunction with bottom pouring metallurgical vessels and existing tube changers thereby obviating the need for further development of the changer mechanisms.

Accordingly the present invention provides a refractory pouring-assembly component suitable for use with a tube changing mechanism to provide a replaceable pouring means comprising an elongate tubular body having a throughbore for pouring of molten metal during continuous casting from a tundish into a mould wherein the refractory pouring component is an isostatically pressed, heat- and wear-resisting refractory one-piece composite body which is shaped to provide at one end a smooth, flat plate surface in which there is defined an aperture, the peripheral edge around said aperture being formed of a hard refractory material to provide an edge which during a tube changing operation is capable of cutting a skin or shell of solidified melt formed within the throughbore of the pouring assembly during pouring of molten metal therethrough, whilst the remainder of said body is formed to a tubular shape from a thermal shock-resistant material to provide for pouring of melt.

It is preferred that the said component is formed from silicon nitride-bonded or silicon oxy-nitride-bonded materials selected from alumina/graphite, zirconia/-graphite, magnesia/graphite or appropriate mixtures thereof. In this way a single component having a substantially uniform composition meeting the defined use requirements can be made.

Alternatively a co-pressed configuration is possible whereby an annulus around the aperture in the flat plate surface is made from a material having the requisite strength, thermal shock resistance and physical compatibility with the remaining plate and SES body material. A specifically formulated $Al_2O_3$ $SiO_2$ $ZiO_2$ C material is suitable within an alumina graphite host body. This of course requires controlled packing of the isostatic-pressing mould in a manner known per se using materials selected in accordance with this invention. The components of this material are usually such that the alumina exceeds about 45% by weight, silica and zirconia are in lesser amounts such that the zirconia may exceed the quantity of silica and still allow a small quantity of carbon to be included. Thus a desirable composition comprises 53% alumina, 18% silica, 24% zirconia and 3% carbon with the balance being minor amounts of typical materials used in this art. In this alternative arrangement it is not necessary to rely on silicon nitride or silicon-oxy-nitride bonding.

Thus this invention approaches the problem of imperfect seals with a new solution in that totally new refractory components are used in the pouring assembly. Each of the previously used sliding upper and lower plates of the tube changer system, the tundish bottom nozzle or block and the pouring tube is now replaced. In place of four components, two components are provided by this invention. Thereby eliminating two of the troublesome joints in the pouring/changer assembly. If desired it is possible only to replace the lower plate of the tube changer and the conventional pouring tube with a composite tube/slide plate of this invention since this is the region normally most subject to wear and leakage caused by tube changing. Previously this would not have been contemplated due to the fundamentally different tasks of the respective components of the four piece assemblies. The plates of the tube changer have to be sufficiently hard as to be able to sever cleanly the frozen melt skin or shell formed during pouring of melt through the assembly whilst the pouring tube leading from the changer plates into the mould must be capable of withstanding thermal shocks. These requirements are generally considered to be opposing in that a material having suitable hardness characteristics is of generally poor resistance to thermal shock and vice versa. However it is now surprisingly found that is possible to make in a single step a refractory component having the requisite hardness and thermal shock resistant properties using the above-mentioned materials or the like.

As mentioned above the invention may be applied to the upper tube changer fixed plate/tundish block or nozzle parts of the pouring assembly or to the lower sliding plate/pouring tube parts of the pouring assembly. Best advantages are obtained with replacement of all known components with the new composite components of this invention.

BRIEF DESCRIPTION OF THE DRAWINGS

The invention will now be further described with reference to the accompanying drawings in which.

DESCRIPTION OF THE PREFERRED EMBODIMENTS

Example 1

Figure 2:
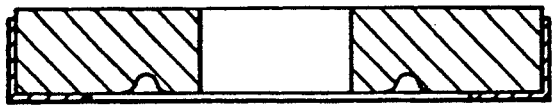
FIG. 2 is a section through a conventional pouring tube adapted to mate with the lower slide plate shown in FIG. 1.
Figure 1:
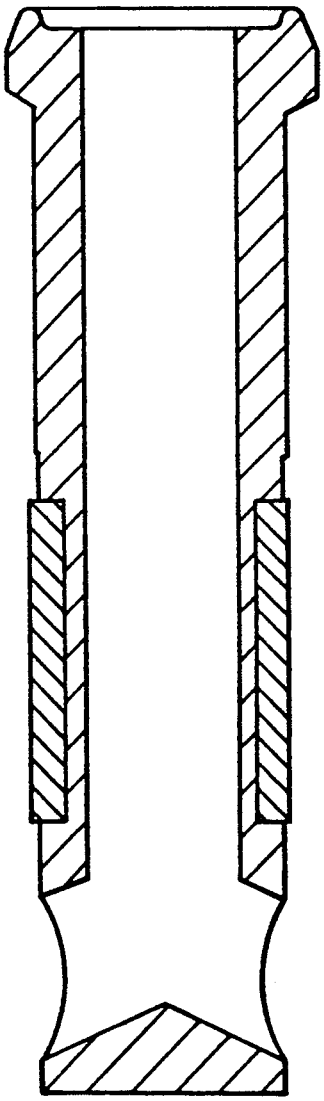
FIG. 1 is a section through a conventional lower slide plate of a tube changer.
Figure 3:
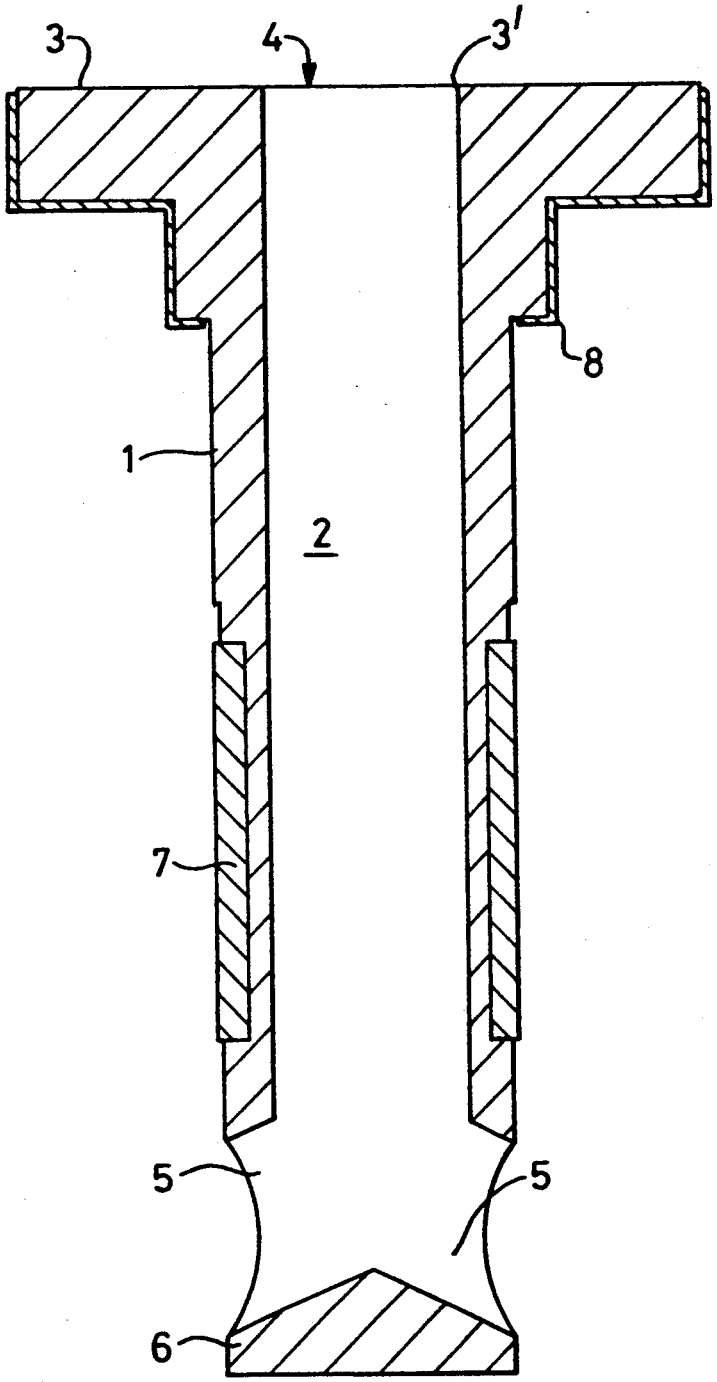
FIG. 3 is a section through a pouring tube of this invention which replaces the components shown in FIGS. 1 and 2.

Referring to FIG. 3 of the drawing a refractory pouring body (1) having a throughbore (2), for use with a tube changing mechanism to provide a replaceable means for pouring of molten metal during continuous casting from a tundish into a casting mould, is isostatically pressed from powder refractory materials and binders selected to impart heat- and wear-resisting properties to the refractory one-piece composite body (I) which is formed by the isostatic pressing. The pressing operation to mould the refractory powder material is carried out in a manner generally known per se using a flexible mould to provide a shaped refractory body (1) having at one end of the body a flat plate surface (3) whilst the remainder of the body (I) is of generally cylindrical shape. Arbors and sacrificial void formers (if necessary) are inserted in the mould which is packed with the powder refractory/binder materials in order to provide in the pressed composite an axial throughbore (2) extending from an aperture (4) in the plate (3) to divergent outlets (5) at the tip (6) of the pouring body (1). By selecting refractory materials from alumina graphite, zirconia graphite or magnesia graphite, using silicon-nitride ($Si_3N_4$) or silicon oxy-nitride ($Si_2ON_2$) as binder, with appropriate filling and packing of the mould it is possible to ensure that the peripheral edge (3') around said aperture (4) provides an edge which during a tube changing operation is capable of cutting a skin or shell of solidified melt formed within the throughbore of the pouring assembly during pouring of molten metal therethrough and that the body (1) is formed of a thermal shock-resistant material. Since the embodiment under discussion is intended for use as a submerged entry nozzle a band (7) of wear-resistant refractory material such zirconia or high zirconia/-graphite mix is provided in a manner known per se. Further, the known means of preventing physical damage during handling by the tube changer, i.e. a protective metal can (8) is fitted after normal finishing of the refractory composite. These finishing steps may include fine grinding of the plate surface (3).

In use the tube changer handles the composite refractory in much the same way as for the known two part assembly, using the underside of the metal can (8) to receive thrust to locate and support the composite pouring tube for use beneath either the conventional two part upper changer plate and tundish nozzle or the new composite of this invention as will be described hereinbelow.

Example 2

Figure 4:
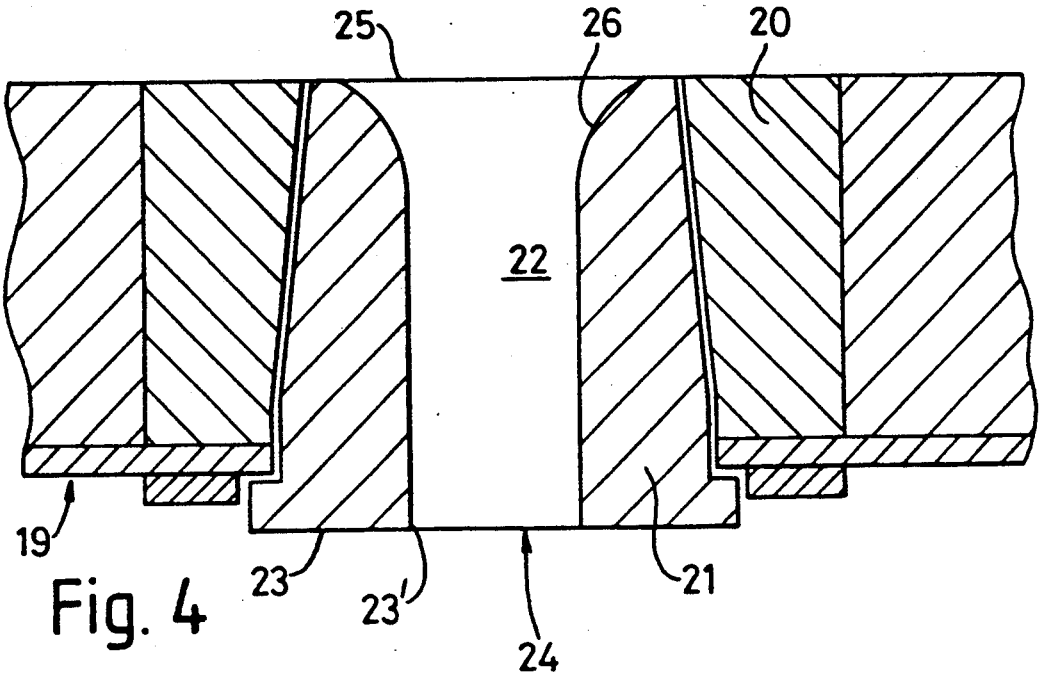
FIG. 4 is a section through a pouring nozzle with integral upper changer plate for fixing in the bottom of a tundish to form the upper part of a pouring assembly provided in accordance with this invention.

Referring to FIG. 4 of the drawing a refractory pouring nozzle (21) for location in the well block (20) in the bottom of a tundish (19), has a throughbore (22) and an integrally formed plate surface (23) for use with a tube changing mechanism during continuous casting from a tundish into a casting mould is isostatically pressed from powder refractory materials and binders selected (as discussed hereinbefore) to impart heat- and wear-resisting properties to the refractory one-piece composite body (21) which is formed by the isostatic pressing. The pressing operation to mould the refractory powder material is carried out in a manner generally known per se using a flexible mould to provide a shaped refractory body (21) having at one end of the body a flat plate surface (23) whilst the remainder of the body (21) is optionally of tapered or cylindrical shape. Arbors and sacrificial void formers (if necessary) are inserted in the mould which is packed with the powder refractory/-binder materials in order to provide in the pressed composite an axial throughbore (22) extending from an aperture (24) in the plate (23) to inlet (25) having a shape adapted to provide a seating surface (26) for a stopper (not shown). By selecting refractory materials from alumina graphite, zirconia graphite or magnesia graphite, bonded using silicon nitride or silicon oxy-nitride, with appropriate filling and packing of the mould it is possible to ensure that the peripheral edge (23') around said aperture (24) provides an edge which during a tube changing operation is capable of cutting a skin or shell of solidified melt formed within the throughbore of the pouring assembly during pouring of molten metal therethrough whilst the body (21) may be optionally formed of a thermal shock-resistant material. Normal finishing of the refractory which may include fine grinding of the plate surface (23) is carried out.

Example 3

Figure 5:
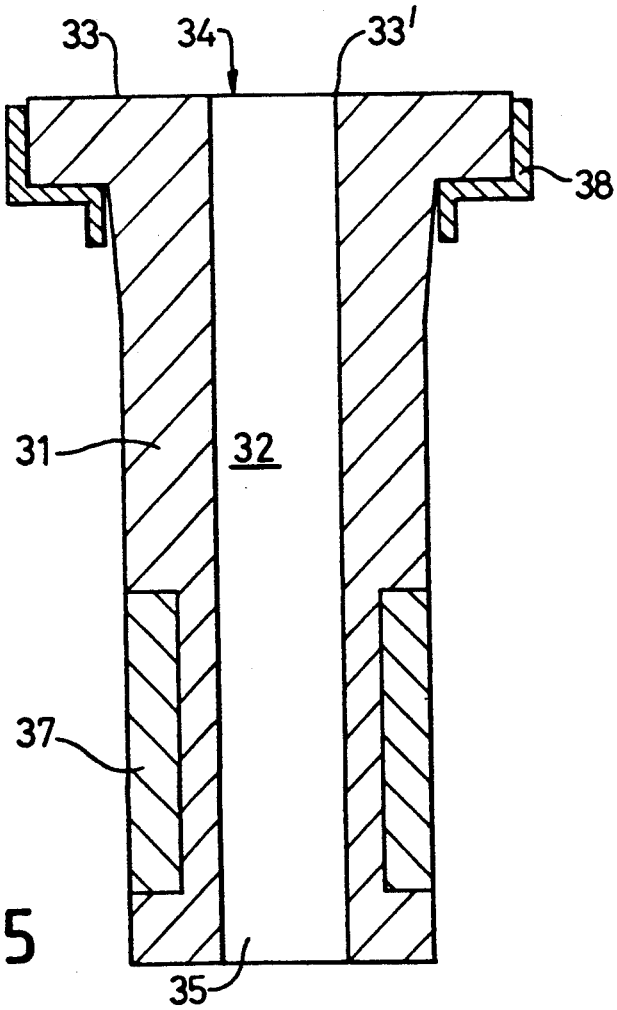
FIG. 5 is a section through a pouring component (SES) with integral lower slide changer plate for presentation to a corresponding upper plate in an upper part of a pouring assembly provided in accordance with this invention.

A further embodiment of the invention is shown in FIG. 5 of the drawings. In this case a submerged entry shroud (SES) is shown and it is formed in a manner generally equivalent to that described in Example I to provide a refractory pouring body (31) with a throughbore (32) and at one end of the body (31) a flat plate surface (33) whilst the remainder of the body (31) is of generally cylindrical shape for use with a tube changing mechanism as described before. Again by selecting appropriate refractory materials (as discussed hereinbefore) it is possible to ensure that the peripheral edge (33') around said aperture (34) provides an edge which during a tube changing operation is capable of cutting a skin or shell of solidified melt formed within the throughbore of the pouring assembly during pouring of molten metal therethrough and that the body (31) is formed of a thermal shock-resistant material. Since the embodiment under discussion is intended for use as a submerged entry shroud a band (37) of wear-resistant refractory material such as zirconia or high zirconia/graphite mix is provided in a manner known per se.

As before to prevent physical damage during changing a protective metal can (38) is fitted, and normal finishing of the refractory composite which may additionally include fine grinding of the plate surface (33) is carried out.

EXAMPLE 4

Figure 6:
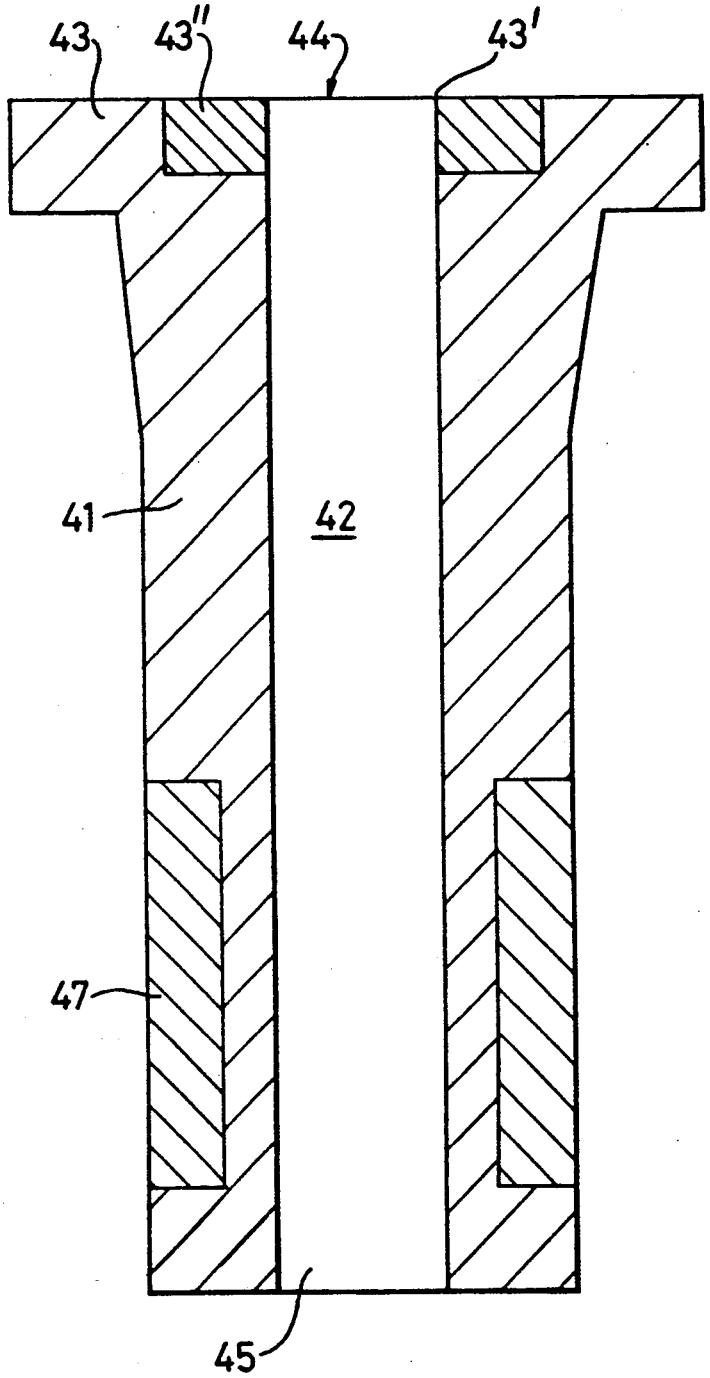
FIG. 6 is a section through a pouring component (SES) similar in function to that of FIG. 5 but comprising an annular co-pressed enhanced-characteristic material within a conventional alumina graphite body having a conventional zirconia slag-wear-resisting band.

As shown in FIG. 6 it is also possible to prepare the SES and outer plate region (43) from conventional alumina graphite material but to selectively enhance the region (43") around the aperture (44) in the plate surface (43) by an alternative material which at the same time exhibits the required mechanical strength, thermal shock resistance to operate as the "cutting edge" (43') during the tube change together with total compatibility with the physical properties of the remaining alumina/graphite body (41). In this embodiment the composition chosen includes 53% alumina, 18% silica, 24% zirconia and 3% carbon (as graphite) with the balance being minor amounts of typical materials used in this art. In other respects this embodiment is similar to that of Example 3 and parts thereof are numbered in an analogous fashion. Since this unit is manufactured in a single co-pressing step there is no risk of steel penetration at the interface.

The advantages of this invention are that the proposed pouring assembly by using upper and lower components of isostatically pressed graphitised alumina or graphitised alumina/zirconia mix or the like heat resisting, wear resisting ceramic materials produces a high integrity rigid system which completely eliminates two of the previous high risk joints thereby reducing the disadvantages of gas leakage. This leads to less build up of alumina and choking of the pouring tubes. Another advantage lies in the improved control of the moveable system arising from the rigidity of the new system. Additionally by supplying a composite pouring body, there is a reduction of on-site assembly work which makes for improved quality control.

Properties of components of the invention, (a) of the common body material type, as for Examples 1 to 3, and (b) copressed compatible plate and shroud phases, as for Example 4, in comparison with prior art slide gate (SG) plates and subentry shrouds (SES) are indicated in Table I below. Preferred compositions including up to 4% matrix-forming (bonding) materials are shown in Table II.

TABLE I

| | | | PREFERRED MATERIAL PROPERTIES | | | | | |
|---|---|---|---|---|---|---|---|---|
| | | | COMMON BODY (a) | | COMPATIBLE CO-PROCESSED PHASES (b) | | | |
| | | | | | plate | | shroud | |
| Property | SG plate | SES | range | typical | range | typical | range | typical |
| Bulk Density g/ml | 3.05–3.15 | 2.15–2.40 | 2.55–2.68 | 2.62 | 2.77–2.91 | 2.86 | 2.25–2.45 | 2.38 |
| App. Porosity % | 5–20 | 14–20 | 13–15.6 | 14.3 | 14–17.2 | 15.7 | 15–19 | 17.0 |
| Cold Crushing Strength $MN/m^2$ | 137–157 | 20.6–28.5 | 47–60 | 54.4 | 150–170 | 162 | 16.2–21.5 | 18.8 |
| Modulus of Rupture $MN/m^2$ | 45.7–52.3 | 6.0–9.5 | 16–20.5 | 18.4 | 49–57 | 54 | 5.5–7.5 | 6.3 |
| Hot modulus 1500° C. $MN/m^2$ | 12.7–15.7 | 6.0–8.8 | 14–18 | N/A | 12.5–15 | 14 | 5.3–7.3 | 6.2 |
| Thermal Expan. 1500° C. % | 0.9–1.3 | 0.2–0.4 | 0.5–0.7 | 0.6 | 0.6–0.85 | 0.8 | 0.3–0.5 | 0.4 |

TABLE II

| | Compatible Co-pressed Phases | | | |
|---|---|---|---|---|
| Material | plate range % | plate typical % | shroud range % | shroud typical % |
| $Al_2O_3$ | 51–55 | 53 | 50–54 | 52 |
| $SiO_2$ | 16.5–18.5 | 18 | 13–16 | 15 |
| $ZrO_2$ | 23.5–27 | 24 | 0 | 0 |
| C | 2–4 | 3 | 28–32 | 31 |
| Matrix Bond | 1.5–2.5 | 2 | 1–4 | 2 |

Whilst the present invention has been described with reference to preferred embodiments, it will be appreciated by those skilled in the art that the invention may be practised otherwise than as specifically described herein without departing from the spirit and scope of the invention. It is therefore to be understood that the spirit and scope of the invention be limited only by the appended claims.

What I claim is:

1. A refractory pouring assembly component comprising a composite component having a slide plate surface having a bulk density in the range of about 3.05 to about 3.15 g/ml, an apparent porosity in the range of about 5 to 20%, a cold crushing strength in the range of about 137 to about 157 $MN/m^2$, a modulus of rupture in the range of about 45.7 to 52.3 $MN/m^2$ at normal temperatures and at 1500° C. in the range of about 12.7 to 15.7 $MN/m^2$, and a thermal expansion in the range of about 0.9 to 1.3% at 1500° C., the said composite component further having a sub-entry pouring tube portion having a bulk density in the range of about 2.15 to about 2.40 g/ml, an apparent porosity in the range of about 14 to 20%, a cold crushing strength in the range of about 20.6 to about 28.5 $MN/m^2$, a modulus of rupture in the range of about 6.0 to 9.5 $MN/m^2$ at normal temperatures and at 1500° C. in the range of about 6.0 to 8.8 $MN/m^2$, and a thermal expansion in the range of about 0.2 to 0.4% at 1500° C.

2. The refractory component of claim 1 wherein the said component is formed from materials selected from the group consisting of alumina graphite, zirconia graphite, magnesia graphite and mixtures thereof, which are bonded by a silicon nitride- or silicon oxynitride-bonding phase.

3. The refractory component of claim 2 wherein the component is formed from materials comprising from 15 to 25% of the silicon nitride-bonding or silicon oxynitride-bonding phase.

4. The refractory component of claim 2 wherein the said materials are mixed such that said component has a substantially uniform composition.

5. The refractory component of claim 1 or claim 2 wherein refractory materials are selected and mixed to provide at least two compatible compositions which are co-pressed to form a composite body in which there is provided an annulus around the aperture in the slide plate surface having a composition of said materials which provides the requisite strength and thermal shock resistance to provide a cutting edge around the aperture and exhibits physical compatibility with the other composition(s) which make up said remaining plate and body.

6. The refractory component of claim 5 wherein the composition of said annulus comprises a mixture of alumina, silica, zirconia and graphite and said remaining plate and body composition comprises mainly alumina graphite.

7. The refractory component of claim 6 wherein the composition of said annulus comprises from 51 to 58% alumina, from 16.5 to 18.5% silica, from 23.5 to 27% zirconia and from 2 to 4% graphite with the balance being minor amounts of other refractory materials.

8. The refractory component of claim 6 wherein the composition of said annulus comprises 53% alumina, 18% silica, 24% zirconia and 3% graphite with the balance being minor amounts of other refractory materials.

9. A pouring-assembly for use in continuous casting comprising isostatically pressed heat- and wear- resistant refractory components, said assembly comprising an upper pouring nozzle part locatable in a tundish having an integrally formed plate surface and a cooperating one-piece lower part which has an elongate sub entry pouring tube portion having at one end a smooth, flat slide plate surface in which there is defined an aperture, the peripheral edge around said aperture being formed of a hard refractory material having bulk density in the range of about 3.05 to about 3.15 g/ml, an apparent porosity in the range of about 5 to 20%, a cold crushing strength in the range of about 137 to about 157 $MN/m^2$, a modulus of rupture in the range of about 45.7 to 52.3 $MN/m^2$ at normal temperatures and at 1500° C. in the range of about 12.7 to 15.7 $MN/m^2$, and a thermal expansion in the range of about 0.9 to 1.3% at 1500° C. with said tube portion being formed from a thermal shock-resistant material having a bulk density in the range of about 2.15 to about 2.40 g/ml, an apparent porosity in the range of about 14 to 20%, a cold crushing strength in the range of about 20.6 to about 28.5 $MN/m^2$, a modulus of rupture in the range of about 6.0 to 9.5 $MN/m^2$ at normal temperatures and at 1500° C. in the range of about 6.0 to 8.8 $MN/m^2$, and a thermal expansion in the range of about 0.2 to 0.4% at 1500° C.

10. In a refractory pouring-assembly component comprising an elongate tubular body having a throughbore for pouring of molten metal therethrough the improvement comprising forming the refractory pouring component as an isostatically-pressed composite refractory body which is shaped to provide at one end a smooth, flat plate surface in which there is defined an aperture forming an inlet to said throughbore, the peripheral edge around said aperture being formed of a wear-resistant hard refractory material comprising from 51 to 55% alumina, from 16.5 to 18.5% silica, from 23.5 to 27% zirconia and from 2 to 4% graphite with the balance being minor amounts of other refractory materials, whilst the remainder of said body is formed to a tubular shape from a thermal shock-resistant material to provide a sub-entry shroud for pouring of melt into a mould.

11. The component of claim 10 wherein the thermal shock resistant material is alumina graphite.

* * * * *